US008800792B2

(12) United States Patent
Westman et al.

(10) Patent No.: US 8,800,792 B2
(45) Date of Patent: Aug. 12, 2014

(54) MECHANICAL COUPLING IN A DRAFTGEAR

(75) Inventors: Anders Westman, Falun (SE); Fredrik Hiswals, Falun (SE)

(73) Assignee: Ego International B.V., Brussels (BE)

( * ) Notice: Subject to any disclaimer, the term of this patent is extended or adjusted under 35 U.S.C. 154(b) by 0 days.

(21) Appl. No.: 13/818,755

(22) PCT Filed: Aug. 9, 2011

(86) PCT No.: PCT/SE2011/050984

§ 371 (c)(1),
(2), (4) Date: Feb. 25, 2013

(87) PCT Pub. No.: WO2012/036610

PCT Pub. Date: Mar. 22, 2012

(65) Prior Publication Data

US 2013/0146558 A1 Jun. 13, 2013

(30) Foreign Application Priority Data

Sep. 14, 2010 (SE) ..... 1050952

(51) Int. Cl.
*B61G 3/00* (2006.01)

(52) U.S. Cl.
USPC ..... 213/90; 213/75 R

(58) Field of Classification Search
USPC ..... 213/90, 75 R, 91, 93, 95, 100 R, 104, 213/120, 130, 133, 149
See application file for complete search history.

(56) References Cited

U.S. PATENT DOCUMENTS

| | | | | |
|---|---|---|---|---|
| 2,107,218 | A * | 2/1938 | Scharfenberg | 213/76 |
| 2,214,036 | A * | 9/1940 | Van Dorn | 213/76 |
| 4,344,542 | A * | 8/1982 | Knight | 213/188 |
| 4,627,545 | A * | 12/1986 | Herbert et al. | 213/100 R |
| 4,765,496 | A * | 8/1988 | Diller | 213/75 TC |

(Continued)

FOREIGN PATENT DOCUMENTS

| | | | |
|---|---|---|---|
| BE | 406889 | C | 1/1935 |
| DE | 660833 | C | 6/1938 |
| DE | 662874 | C | 7/1938 |
| GB | 419590 | A | 11/1934 |

OTHER PUBLICATIONS

International Search Report, dated Jan. 17, 2012, from corresponding PCT application.

*Primary Examiner* — Jason C Smith
(74) *Attorney, Agent, or Firm* — Young & Thompson

(57) ABSTRACT

A mechanical coupling, particularly in a draftgear in rail vehicles, includes a central plate (5) turnably mounted in a coupler head and having a link (7) pivoted in the same, and including a hooking mechanism for detachable hooking up of the central plate and the link in the non coupled position of the coupling, and a releasing device (10) for the automatic detachment of the hooking mechanism upon coupling. The hooking mechanism includes a hooking rod (12) pivotally connected with the central plate, which rod, by a lug (16), clutches a collar (11) arranged in the coupler head and, upon activation of the releasing device, detaches from the collar. A leaf spring (13) is arranged in the coupler head in order to, in abutment against the hooking rod, force the same, under the bias from the spring, to be pressed against the collar in the hooked up and disengaged positions.

14 Claims, 3 Drawing Sheets

(56) References Cited

U.S. PATENT DOCUMENTS

| | | | | |
|---|---|---|---|---|
| 4,893,716 | A * | 1/1990 | Diller | 213/75 TC |
| 5,014,864 | A * | 5/1991 | Richter et al. | 213/104 |
| 5,499,728 | A * | 3/1996 | Rumsey | 213/101 |
| 6,000,564 | A * | 12/1999 | Grau et al. | 213/100 R |
| 7,497,345 | B2 * | 3/2009 | Brabb et al. | 213/100 R |
| 2007/0084818 | A1 * | 4/2007 | Brabb et al. | 213/100 R |
| 2013/0105431 | A1 * | 5/2013 | Hansson et al. | 213/179 |
| 2013/0146558 | A1 * | 6/2013 | Westman et al. | 213/90 |

* cited by examiner 9
6
1
3
7
8
5
12
4
10
2

13
17
16
18
12
r
c
20
21
22

MECHANICAL COUPLING IN A DRAFTGEAR

TECHNICAL FIELD OF THE INVENTION

The invention relates to a mechanical coupling in a draftgear, particularly a draftgear in rail vehicles. More precisely, the invention relates to an improved mechanical coupling of the type comprising a central plate turnably mounted in a coupler head and having a coupling link pivoted in the same, and including a hooking mechanism for detachable hooking up of the central plate and the link in the non coupled position of the coupling, as well as including a releasing device for the automatic detachment of the hooking mechanism upon coupling, wherein the hooking mechanism comprises a hooking rod pivotally connected with the central plate, which rod, by a lug, clutches a collar arranged in the coupler head and, upon activation of the releasing device, is detached from said collar.

BACKGROUND AND PRIOR ART

Couplings of this type are found in draftgears arranged for the automatic coupling of locomotives and cars. The couplings are contained in a coupler head, which is formed to, upon coupling, force the draftgears to be aligned with each other, typically by the fact that the front of the coupler head has a guide cone as well as an opening for the guide cone of the meeting coupler head. Upon coupling, the guide cone of the meeting coupler head is brought in through the opening and actuates the releasing device to detach the hooking mechanism. The central plate is thereby free to be turned for hooking fast the meeting coupling link in a recess formed for the purpose in the periphery of the central plate. Typically, a tension spring is arranged for turning the central plate and for holding the couplings in the coupled position.

In the inactive, non coupled position, the central plate and the coupling link pivoted in the central plate are hooked up in an initial position for coupling. A hooking rod pivoted in the central plate is formed with a lug, which in this position clutches a collar arranged in the coupler head and holds the central plate against the force of previously mentioned tension spring. Upon coupling, the hooking rod is expelled from its engagement with the collar by the effect of the releasing device, which typically is arranged in the form of a rod that is acted upon by the guide cone and loaded by a spring effective to restore the releasing device into its initial position. It will be appreciated that the hooking rod is brought along by the central plate in a reciprocating motion in the turning of the central plate. Furthermore, the lug of the hooking rod is formed with a tilted front edge, which slides across the collar in the hooking motion and causes an oscillation of the hooking rod when the lug passes the collar.

In order to guarantee that the lug of the hooking rod is brought into engagement with the collar for the hooking up of the coupling, the hooking rod is biased against the collar. In certain embodiments, this bias is provided by a piston pressing on the hooking rod, which piston is journalled in a housing and driven, for instance, by a helical spring that presses the piston against the hooking rod. A disadvantage of this design is that penetration particles, moisture and corrosion may impair the function of the piston and prevent its motion. This disadvantage may cause the hooking up of the coupling not to occur.

In order to avoid this problem, the invention aims at providing a structurally simple and reliable hooking up of the mechanical coupling in its inactive, non coupled position.

BRIEF SUMMARY OF THE INVENTION

In order to meet this object, according to the invention, there is provided a mechanical coupling of the type indicated by way of introduction, wherein a leaf spring arranged in the coupler head and being in abutment against the hooking rod forces the same, under the bias from the spring, to be pressed against the collar in the hooked up as well as the disengaged position.

By the fact that movable parts are entirely lacking in the solution provided, a reliable function is achieved, and in addition a simplified mounting, reduced weight and better total economy.

The leaf spring may be formed in several ways, and may, for instance, have the shape of an elongate element, which, from an end attached inside the coupler head, extends archedly into abutment against the hooking rod.

The leaf spring may alternatively be made as an endless element that is squeezedly arranged between the hooking rod and an oppositely situated point of attachment inside the coupler head.

The leaf spring may also alternatively be realised as a helical element, one end of which is attached inside the coupler head and the other and free end of which abuts against the hooking rod.

In order to avoid that the free end of the leaf spring hooks on to the hooking rod when this moves between the disengaged and the hooked up position, the free end of the leaf spring may be formed with a radius.

In order to reduce the friction between the leaf spring and the hooking rod, the free end of the leaf spring may be formed with a radius that abuts in sliding contact against the hooking rod. For the same reasons, the abutment surface of the leaf spring may carry a wear protection in the form of a covering or a sliding block.

In order to distribute the wear over a larger surface of the hooking rod, it may be advantageous to arrange said radius in a plane that intersects the longitudinal axis of the hooking rod at an oblique angle, whereby the contact between the hooking rod and the leaf spring is in the form of a contact line running obliquely across the width of the hooking rod.

The attached end of the leaf spring may be attached to the collar whereby a compact and space-saving design is achieved. For the same reasons, the collar may advantageously be formed on a bracket carried on a housing serving for the bearing of a releasing device formed as a spring-loaded rod.

In a space-saving embodiment, the leaf spring is helical in a plane intersecting the hooking rod, and the hooking rod extends through the leaf spring coil.

BRIEF DESCRIPTION OF THE DRAWINGS

The invention is explained in more detail below, reference being made to the accompanying, schematic drawings, wherein.

DETAILED DESCRIPTION OF THE INVENTION

Figure 1:
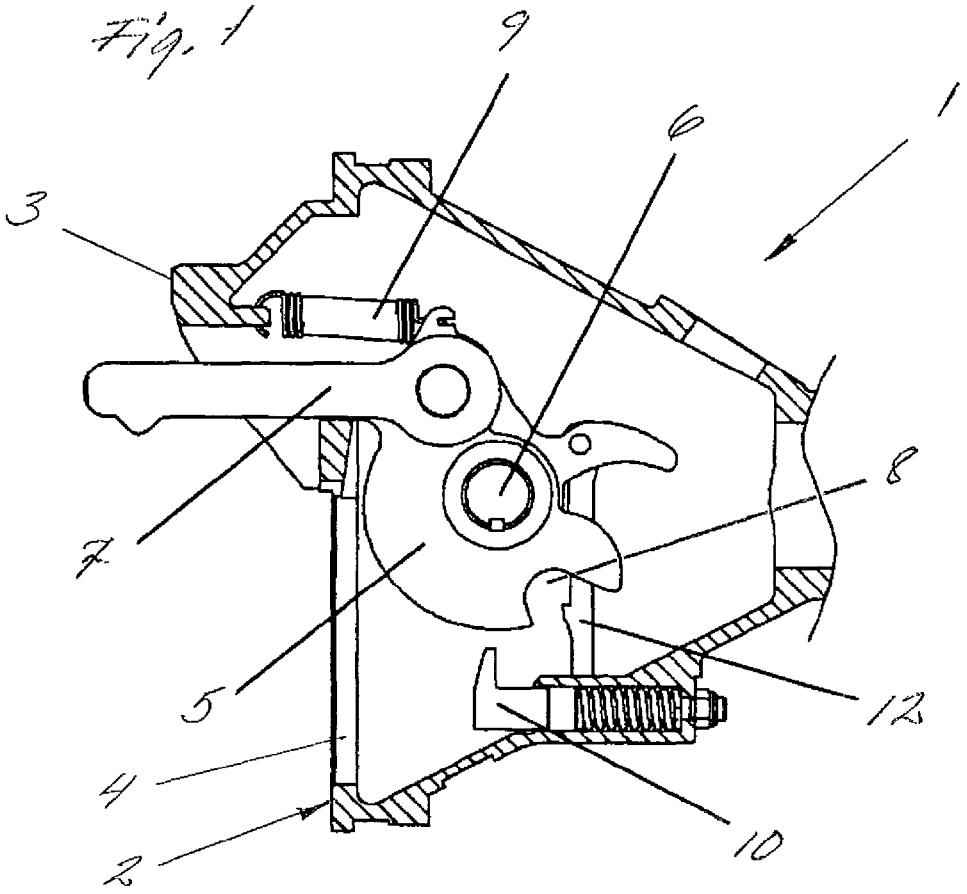
FIG. 1 shows, in a simplified cross-section from above, a coupler head broken-away from a draftgear.

FIG. 1 shows a coupler head 1, which has a front plate 2 having a projecting guide cone 3 and an opening 4 intended for the receipt of the guide cone (not shown) of a meeting coupler head upon coupling of the draftgears. In the coupler head, there is contained a mechanical coupling comprising a central plate 5, which is turnably mounted on a main shaft 6 mounted in the coupler head. A coupling link 7 is pivoted in the central plate, which in its periphery has a recess 8 for hooking on to a corresponding coupling link of a meeting draftgear. A tension spring 9 biases the central plate toward the coupled position shown in FIG. 1. The reference numeral 10 designates a releasing device 10 that, by the guide cone of a meeting coupler head, is actuated to detach a hooking mechanism described in more detail below, reference being made to FIGS. 2 and 3. For the sake of completeness, it should be mentioned that, in the coupler head, there is typically arranged a driven piston effective to turn the central plate in the opposite direction upon uncoupling.

Figure 2:
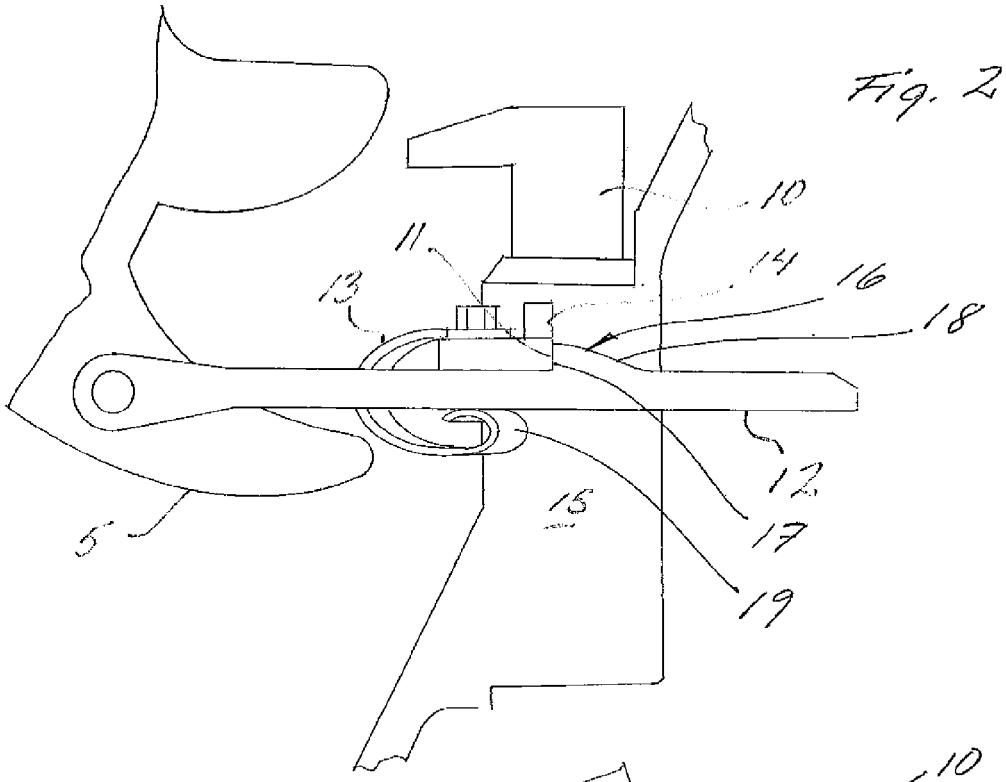
FIG. 2 shows, in a broken-away view from below, on a greater scale and in the hooked up position, a hooking mechanism mounted in the coupler head.
Figure 3:
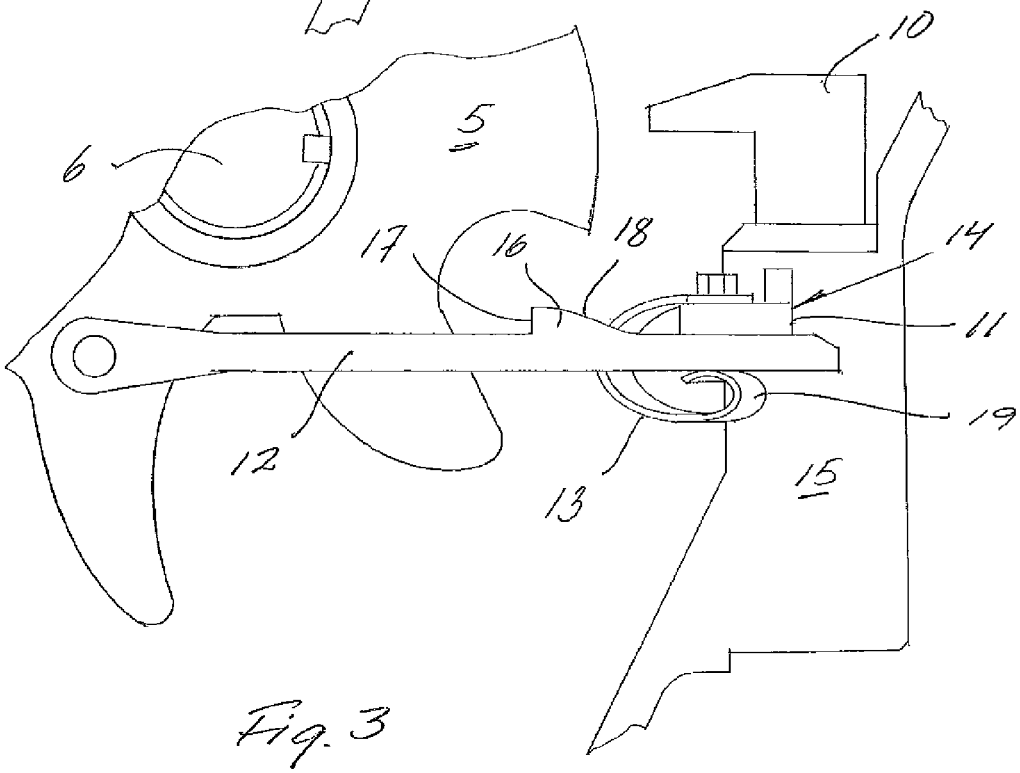
FIG. 3 is a corresponding view that shows the hooking mechanism in the disengaged position.

FIG. 2 shows the hooking mechanism in a broken-away portion of the coupler head according to FIG. 1. The hooking mechanism comprises a collar 11, a hooking rod 12 and a leaf spring 13. The collar 11 is arranged in the coupler head, and is, in the embodiment example, formed on a bracket 14 that is carried on a housing 15 for the bearing of the releasing device 10. The collar 11 may alternatively be arranged in another suitable way in the coupler head 1. The hooking rod 12 is pivoted in the central plate and is brought along in its turning around the main shaft 6. The hooking rod has a lug 16 that, with its back side 17, is arrested by the collar 11 in the hooked up position shown in FIG. 2. Upon disengagement, the releasing device pushes away the hooking rod from the collar, whereby the central plate becoming free to turn in order to complete the coupling with the meeting draftgear in the position shown in FIG. 3. The front side 18 of the lug is tilted to be slidable across the collar upon hooking up of the mechanical coupling.

In one of its ends, the leaf spring 13 is fixedly anchored in the coupler head, and, in the embodiment example, more precisely attached on the bracket 14 that provides the collar 11. The free end 19 of the leaf spring abuts against the hooking rod 12 and presses the same against the bracket and against the collar 11. The free end 19 of the leaf spring is suitably bent into a radius r in a plane that intersects the longitudinal axis of the hooking rod at an angle. More precisely, the leaf spring 13 of the embodiment example is essentially helical in a plane intersecting the hooking rod, and the hooking rod runs through the leaf spring coil.

Figure 4:
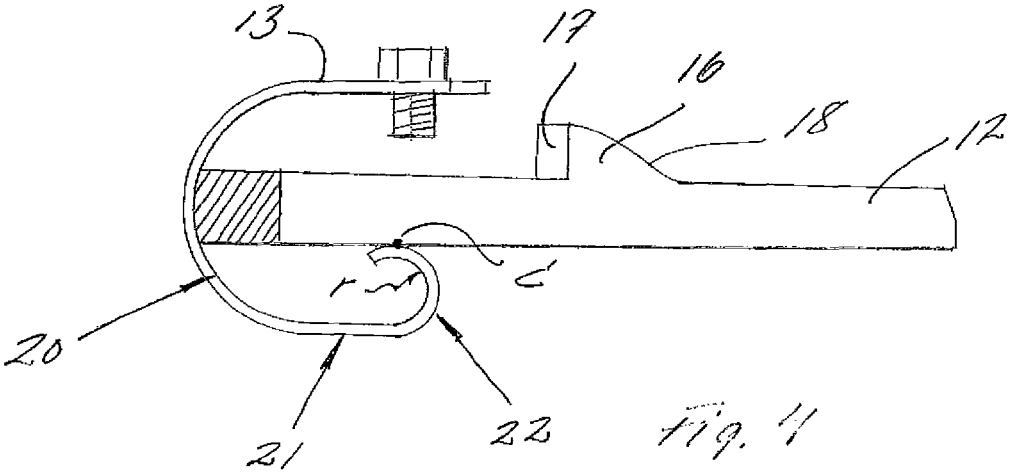
FIG. 4 is a planar view of a leaf spring of a first embodiment included in the hooking mechanism.

The shape of the leaf spring 13 is shown in more detail in FIG. 4, wherein the plane of the drawing intersects the hooking rod at an oblique angle (see the section indicated by hatch lines through the hooking rod). From the end mounted to the bracket 14, the leaf spring 13 extends with an arched segment 20 below and in front of the hooking rod 12, as seen in the direction from the front plate of the coupler head. The arched segment transforms into an essentially plane segment 21 that runs upward behind the hooking rod. The plane segment transforms into an arched segment 22 that, with a radius, abuts against the back side of the hooking rod. The leaf spring 13 abuts against the hooking rod in a contact line running obliquely across the back side of the hooking rod, in FIG. 4 perpendicular to the drawing figure and represented by the point C.

FEASIBLE MODIFICATIONS AND ALTERNATIVE EMBODIMENTS

Figure 5A:
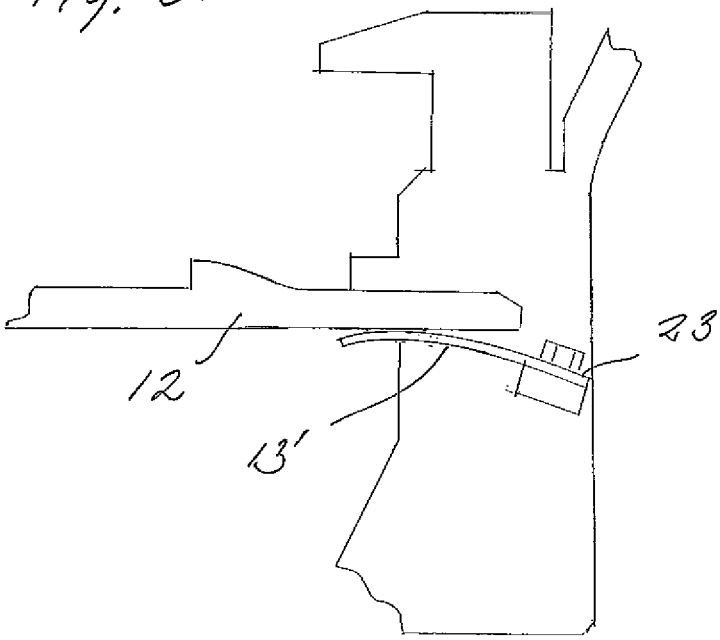
FIGS. 5A-5B show alternative embodiments of the leaf spring included in the hooking mechanism.
Figure 5B:
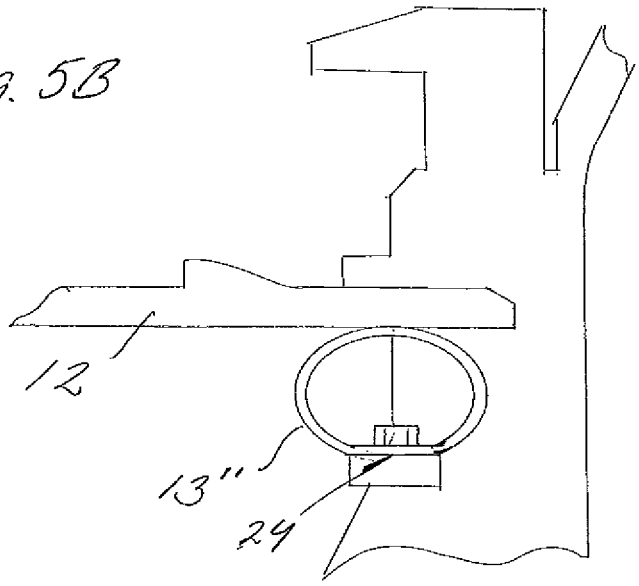

It will be appreciated that the leaf spring 13 may have another shape than the one shown in FIGS. 1-4, which is only an example that is advantageous by virtue of its simple and space-saving embodiment. Thus, the leaf spring may alternatively, as in FIG. 5A, be made as an elongate element 13', which, from an end 23 attached inside the coupler head, extends archedly into abutment against the hooking rod 12. As is shown in FIG. 5B, the leaf spring may also alternatively be made as an endless element 13" that is squeezedly arranged between the hooking rod 12 and an oppositely situated point of attachment 24 inside the coupler head.

In all cases, the leaf spring may be arranged to extend without the intersecting inclination in relation to the hooking rod that is the case in the embodiment example shown. Thus, the leaf spring may alternatively be orientated to extend primarily parallel to the hooking rod, or have its principal extension perpendicular to the hooking rod, if this is preferred, for instance, for reasons of space or mounting.

It will also be appreciated that the attachment of the leaf spring in the coupler head may be made in another way than in the embodiment example shown. More precisely, the leaf spring may, if suitable, be attached to the inside of the coupler head housing, or be attached in an attachment formed on the inside.

Furthermore, the leaf spring may, where appropriate, have a wear protection in the form of a covering, or in the form of a sliding block of friction-reducing and hard-wearing material carried on the leaf spring.

It will further be appreciated that the collar 11 co-operating with the hooking rod may be arranged in another way in the coupler head. Particularly, an alternative is contemplated wherein the collar is formed in a recess in which the lug of the hooking rod engages in the hooked up position. In another alternative, the collar may be formed on a projection so as to, in the hooked up position, engage with a countersunk lug formed by removal of material from the hooking rod. Therefore, the invention should not be considered to be limited to the specific embodiment explained in the drawings and the description, but to the solution seen in the attached claims.

The invention claimed is:

1. Mechanical coupling usable in a draftgear in rail vehicles, comprising:

a coupler head (1);

a collar (11) arranged in the coupler head (1);

a central plate (5) turnably mounted in the coupler head;

a coupling link (7) pivoted in the central plate (5);

a hooking mechanism for detachable hooking up of the central plate and the coupling link in a non-coupled position, the hooking mechanism including i) a releasing device (10) for automatic detachment of the hooking mechanism upon coupling, ii) a hooking rod (12) pivotally connected with the central plate, the hooking rod having a lug (16), wherein the hooking rod, by the lug (16), clutches the collar (11) arranged in the coupler head and, upon activation of the releasing device, is detached from said collar; and a leaf spring (13, 13', 13") arranged in the coupler head in abutment against the hooking rod (12), wherein the hooking rod, under bias from the leaf spring (13, 13', 13"), is pressed against the collar (11) in a hooked up position and in a detached position.

2. Mechanical coupling according to claim 1, wherein the leaf spring (13') is an elongate element, which, from an end (23) attached inside the coupler head, extends archedly into abutment against the hooking rod (12).

3. Mechanical coupling according to claim 2, wherein a free end (19) of the leaf spring is formed with a radius (r).

4. Mechanical coupling according to claim 2, wherein the leaf spring (13) carries a wear protection in the form of a covering or a sliding block.

5. Mechanical coupling according to claim 2, wherein the leaf spring (13) is attached to the collar (11).

6. Mechanical coupling according to claim 2, wherein the leaf spring (13) carries a wear protection in the form of a covering or a sliding block.

7. Mechanical coupling according to claim 1, wherein the leaf spring (13") is a ring-shaped element that is squeezedly arranged between the hooking rod (12) and an oppositely situated point of attachment (24) inside the coupler head.

8. Mechanical coupling according to claim 7, wherein the leaf spring (13) is attached to the collar (11).

9. Mechanical coupling according to claim 1, wherein the leaf spring (13) is a helical element with one end attached inside the coupler head and a free end (19) in abutment against the hooking rod (12).

10. Mechanical coupling according to claim 9, wherein the leaf spring (13) is helical in a plane intersecting the hooking rod, and the hooking rod (12) extends through the leaf spring coil.

11. Mechanical coupling according to claim 9, wherein the free end (19) of the leaf spring is formed with a radius (r).

12. Mechanical coupling according to claim 1, wherein the leaf spring (13) carries a wear protection in the form of a covering or a sliding block.

13. Mechanical coupling according to claim 1, wherein the leaf spring (13) is attached to the collar (11).

14. Mechanical coupling according to claim 13, wherein the collar (11) is formed on a bracket (14) carried on a housing (15) serving for the bearing of a releasing device formed as a spring-loaded rod (10).

* * * * *